United States Patent [19]

Habicht

[11] Patent Number: 5,000,077

[45] Date of Patent: Mar. 19, 1991

[54] ENCLOSED ADJUSTABLE SERVO-ACTUATOR

[76] Inventor: Helmut Habicht, 15 Royal Park Ter., Hillsdale, N.J. 07642

[21] Appl. No.: 377,064

[22] Filed: Jul. 10, 1989

[51] Int. Cl.[5] ..... F15B 13/16

[52] U.S. Cl. ..... 91/361; 91/1; 92/5 R; 92/136; 92/138; 92/13.6; 92/248; 74/104

[58] Field of Search ..... 92/5 R, 136, 140, 248, 92/13.51, 13.6, 13.7, 138, 170.1, 169.1, 170.2; 91/1, DIG. 4, 471, 361, 266; 74/99, 104

[56] References Cited

U.S. PATENT DOCUMENTS

| | | | |
|---|---|---|---|
| 3,270,624 | 9/1966 | Blaney | 74/104 |
| 3,460,799 | 8/1969 | Sanctuary | 92/138 |
| 3,672,260 | 6/1972 | Gachot et al. | 92/138 |
| 3,709,106 | 1/1973 | Shafer | 74/104 |
| 4,281,588 | 8/1981 | Jaske | 92/136 |
| 4,442,931 | 4/1984 | Montalvo, Sr. | 92/136 |
| 4,533,113 | 8/1985 | Francart, Jr. | 92/130 |
| 4,808,092 | 2/1989 | Funke | 92/170.1 |

FOREIGN PATENT DOCUMENTS

| | | | |
|---|---|---|---|
| 619964 | 4/1927 | France | 92/138 |
| 561264 | 4/1957 | Italy | 92/138 |
| 2033537 | 5/1980 | United Kingdom | 92/248 |

*Primary Examiner*—Edward K. Look
*Assistant Examiner*—Thomas Denion
*Attorney, Agent, or Firm*—Patrick J. Pinto

[57] ABSTRACT

An enclosed adjustable servo-actuator is provided. This servo-actuator includes an elongated hollow cylinder; a first closed end member; a second closed end member; a through passageway is provided in each closed end member; an enclosed housing attached exterior of the hollow cylinder at or near the center of the cylinder, said housing adapted to comunicate with the interior of the hollow cylinder; an elongated piston assembly is slidably carries interior of said hollow cylinder; A torque arm is arrayed to engage said piston assembly by means of a closed-end transverse groove provided in said piston assembly; an output shaft is journaled in said enclosed housing, said output shaft engages said torque arm for converting the linear displacement of the piston to an arcuate rotation of said output shaft; and an adjustment means is provided to selectively limit the arcuate rotation of the output shaft.

20 Claims, 4 Drawing Sheets

ENCLOSED ADJUSTABLE SERVO-ACTUATOR

BACKGROUND OF THE INVENTION

FIELD OF THE INVENTION

With respect to the classification of art as established in and by the United States Patent and Trademark Office, this invention is believed to be found in the general class entitled as "Expansible Chamber Devices" and more particularly "with a linkage or transmission".

Many machinery components such as process valves, louvers, or alarm devices require a servo-actuator to provide a desired degree of angular movement Some of these components, requiring servo-actuators, are mounted on machinery or located on process equipment used in a clean room atmosphere, in the food or pharmaceutical industries, and others in hazardous, or explosive environments. Each of these applications require a servo-actuator which will not contaminate the surrounding environment with pollutants, metal fragments, or sparks.

Therefore it can be seen that a servo-actuator is required to transform linear motion to rotary motion in a compact device while at the same time providing an enclosed non-contaminating unit which has an adjustable angular displacement for use with varied components.

Some of the prior art devices, which are commercially available, utilize a linear cylinder to operate a rotary shaft by means of a pinion and rack system; chain and sprockets; or cable and pulleys. U.S. Pat. No. 2,630,132 as issued to W.J. Hughes on Mar. 3, 1953 discloses a servo-actuator which provides rotary motion as a result of linear motion. The patent as issued to Hughes does not show or disclose an enclosed device which would satisfy the environmental requirements of clean rooms or Hazardous locations. The Hughes Patent also discloses a rolling diaphragm arrangement for the piston. This prior art Patent also requires a piston guiding means interior of the piston.

There is a need to provide a fully enclosed servo-actuator which has a minimum of moving parts and is economical to manufacture. There is an additional need to provide a servo-actuator which has an adjusting means for limiting the Angular Displacement of its output shaft.

It is therefore an object of this invention to provide and it does provide, a servo-actuator which is enclosed for safe operation in clean room or hazardous environments.

It is another object of this invention to provide and it does provide, a servo-actuator which has an adjustment means for controlling or limiting the angular displacement of its output shaft.

It is a further object of this invention to provide and it does provide a servo-actuator having an angular displacement great enough to operate disk or butterfly valves to a fully opened condition.

It is still another object of the invention to provide and it does provide a servo-actuator requiring little or no lubricant.

It is yet a further object of this invention to provide and it does provide an economically manufactured servo-actuator adapted to provide adjustable angular displacements up to one hundred-eighty degrees of arc.

This present invention provides a servo-actuator which is operated by a pressurized medium such as a hydraulic fluid or a gas. This servo-actuator requires little or no lubrication and has a minimum number of parts. An adjustment means is provided to limit the angular displacement of the output shaft at one or both extents.

In addition to the above summary the following disclosure is detailed to insure adequacy and aid in the understanding of this invention. This disclosure, however is not intended to cover each new and inventive concept no matter how it may later be disguised either by variations in form or additions by further improvements. For this reason, there has been chosen specific embodiments of a pressure operated servo-actuator. This servo-actuator is fully enclosed and adapted for use in clean room or hazardous environments. These specific embodiments have been chosen for the purpose of illustration and description as shown in the accompanying drawings wherein:

Figure 1:
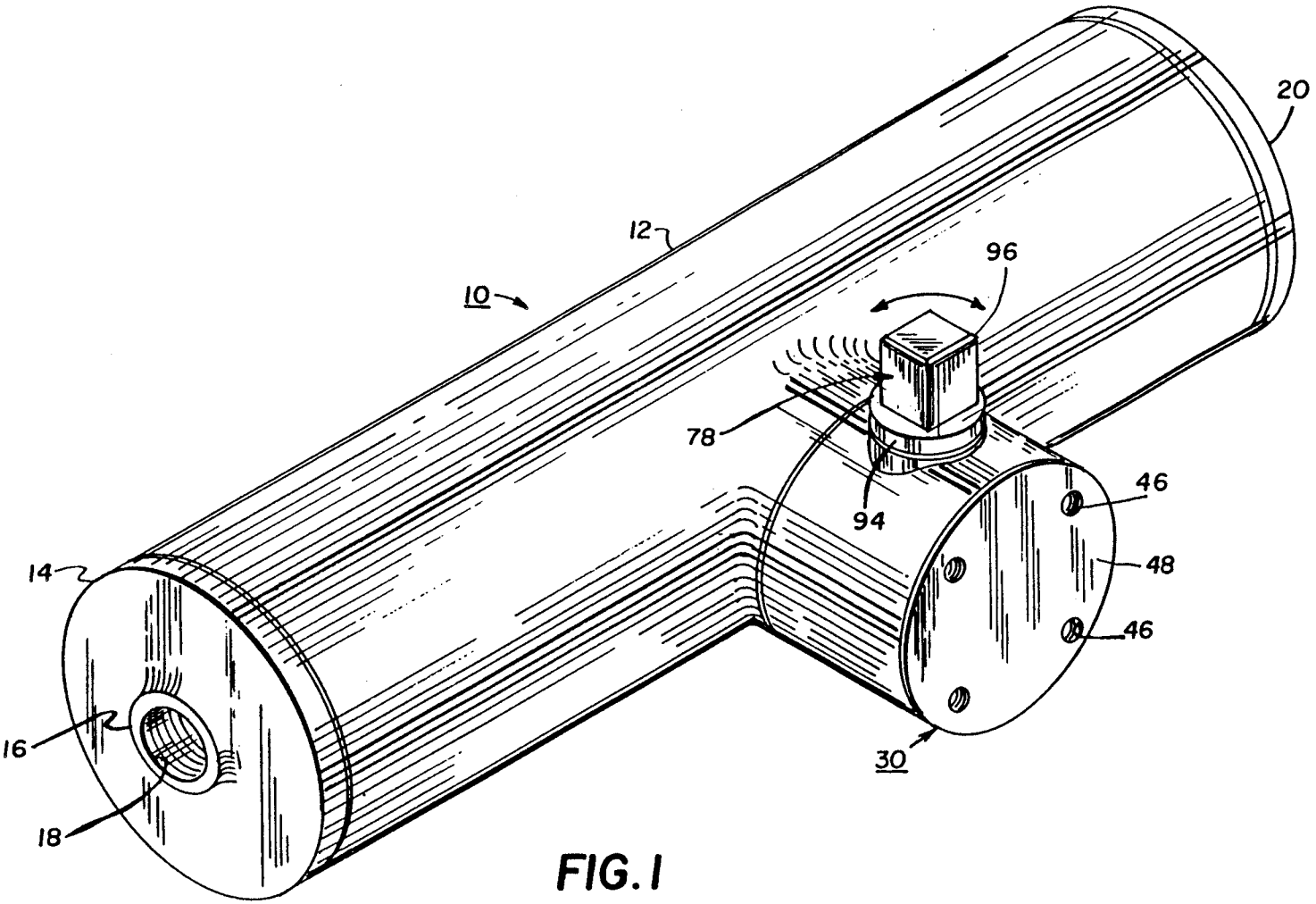
FIG. 1 represents an isometric view of a pressure operated servo-actuator and showing in particular its smooth contour and the arrangement of the output shaft.

In the following description and in the claims, various details are identified by specific names for convenience. These names are intended to be generic in their application. Corresponding reference characters refer to like members throughout the several figures of the drawings. The drawings accompanying, and forming a part of this specification disclose certain details of construction for a pressure operated servo-actuator. These details are for the purpose of explanation, but structural details may be modified without departure from the concept and the principles of the invention. It is anticipated that this invention be may be incorporated in structural forms other than as shown.

DETAILED DESCRIPTION OF THE PREFERRED EMBODIMENT

Figures 2, 3, 4:
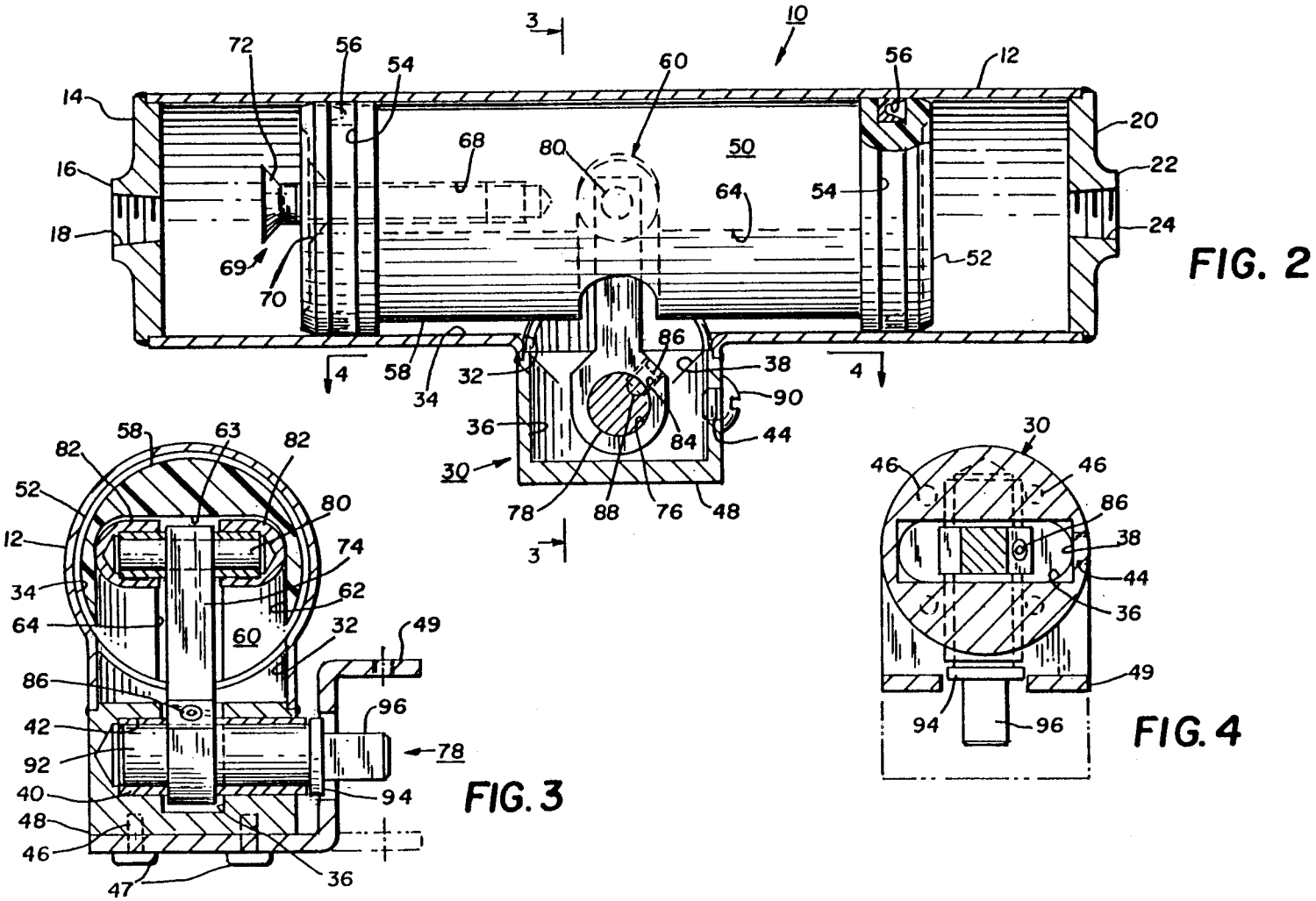
FIG. 2 represents a side elevational view in section of the servo-actuator.
FIG. 3 represents a side elevational view, in section, and taken along line 3—3 of FIG. 2
FIG. 4 represents a top plan view, in section, of the housing portion of the servo-actuator, this view taken along line 4—4 of FIG. 3.

Referring to the drawing and in particular to FIG. 1 and FIG. 2, there is shown a servo-actuator generally identified as 10. This servo-actuator 10 comprises an elongated hollow cylinder portion 12. The cylinder 12 has a first closed end 14. This first closed end 14 is shown as being contoured and having a boss 16 formed at or near its center. A first passageway 18 is formed in and through the boss 16 of the first end 14. This first passageway 18, preferably a female type thread, is adapted for mating with a suitable male pipe thread such as a ⅛ NPT. This first passageway may however be of any suitable type for connection of a conduit carrying a pressurized medium to the servo-actuator 10.

A second closed end 20 is provided at the distal end of the hollow cylinder 12. This second closed end 20 may be contoured similar to the first closed end 14. A boss 22 is shown extending from the exterior face of the second closed end 20. A second passageway 24 is formed in and through the second closed end 20. This passageway 24 is shown as having a female pipe thread but any suitable means for connecting a conduit, not shown, carrying a pressurized medium to the servo-actuator may be used.

A housing portion generally identified as 30 is attached at or near the center of the hollow cylinder 12. This housing 30 is preferably welded to the cylinder 12, but other methods of attachment may be used. Welding has been selected for its retentive and sealing characteristics as well as providing a clean surface when ground smooth. Referring in particular to FIG. 2, FIG. 3, and FIG. 4, the arrangement of the parts interior of the housing 30 and details of their construction are shown. A cylindrical passage 32 is formed through the wall 34 of the hollow cylinder 12. The housing 30, hollow cylinder 12, first end 14 and second end 20 are preferably made of a suitable stainless steel. The contoured parts may be machined from a solid bar or cast with contours as shown and described. An elongated well portion 36 is formed interior of the housing 30. This well portion 36 is shown as having radiused ends. These radiused ends are a result of a machining operation. Other shapes for or the well portion may be used. The open end of the well portion 36 is shown as having a rectangular outline 38. This rectangular outline 38 is provided for clearance purpose. A pair of bearings 40 are press-fit in a bored aperture 42 provided in the housing 30. This aperture 42 is shown as being formed at ninety degrees to the well 36. A threaded access aperture 44 is provided in and through the housing 30 for external access to the well portion 36 of the housing 30. A plurality of blind threaded holes 46 are provided in a closed portion 48 of the housing for mounting of the servo-actuator. Such a mounting arrangement is shown in FIG. 3 and FIG. 4. A formed bracket member 49 is attached to the housing 30 by means of machine screws 47. This bracket may be shaped as shown in solid outline or may be flat as shown in dashed outline. The shape of the bracket 49 is dependent upon the type of device to be connected to the shaft 78.

Figure 5:
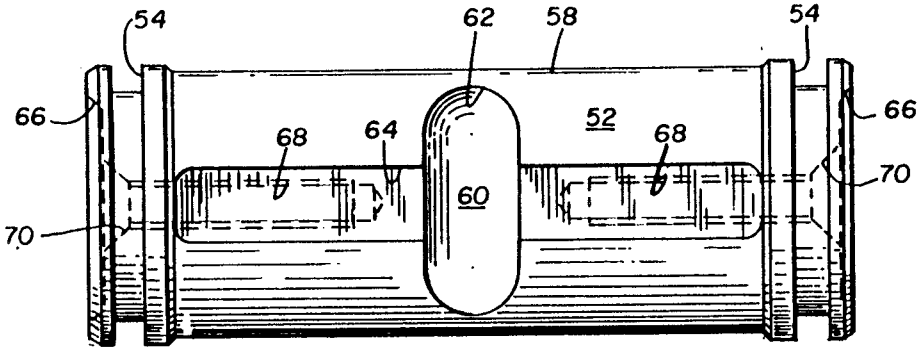
FIG. 5 represents a bottom plan view of a piston of the servo-actuator this view particularly showing the arrangement of a closed end transverse groove and a longitudinal groove.

Referring to FIG. 2 and FIG. 3, a piston assembly 50 is shown interior of the hollow cylinder 12 , Referring to FIG. 2 and FIG. 5, the piston assembly 50 comprises a substantially cylindrical piston 52, preferably made of a plastic, such as an acetal homopolymer, which has annular grooves 54 formed at or near each end. Grooves 54 are adapted to carry a piston sealing means 56 such as a U-cup, but other piston sealing means may be used. A central undercut portion 58 is provided on the piston 52. This undercut 58 is usually selectively chosen by the design considerations, but an undercut of 1.5 mm is generally found to be sufficient.

Figure 6:
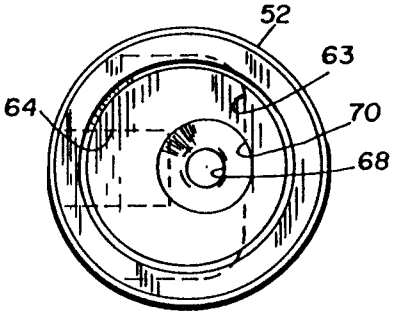
FIG. 6 represents a side elevation view of the piston, shown in FIG. 5.

Referring in particular to FIG. 2, FIG. 5, and FIG. 6 a closed end transverse groove 60 is formed into the undercut portion 58 at or near the center of the piston 52. This transverse groove 60 is shown preferably as having radiused end portions 62, and bottom portion 63. An elongated longitudinal groove 64 is also provided in the piston 52. As shown, this groove 64 extends for the full length of the undercut 58. The length of this groove 64 is selectively determined and will be discussed and become apparent below. The sharpened edges on the outer diameter of the piston 52 have been chamfered as an aid in assembling the servo-actuator 10. The piston 52, as shown and depicted, has been machined from a solid bar of material, it is to be noted that the piston 52 may be molded. Molding would permit other contours for the grooves 60 and 64 to be provided.

A recess portion 66 is provided at each end of the piston 52. This recess 66 allows the pressurized medium to exert a greater force on the piston by presenting a greater surface area when the piston assembly 50 is positioned, adjacent either closed end 14 or 20 of the servo-actuator. A Threaded aperture 68 is provided at one or both ends of the piston 52. This threaded aperture 68 is shown as having a seating means 70 for a head of a machine screw 72. This seating means 70 is shown as being countersunk for a flat-head screw, but other seating means may be used for other types of screws.

Referring to FIG. 2, FIG. 3, and FIG. 4, an elongated torque arm 74 has a through aperture 76 at a hub end. This aperture 76 is adapted to closely fit onto and over an elongated shaft 78. The distal end of the torque arm 74 carries an axle 80, which extends a determined distance from each of the side extents of the torque arm 74. A pair of shaped rollers 82, each having press-in bearing 83, are journaled on the axle 80. These rollers 82 are shaped to closely mate with the contour of the closed transverse groove 60. The torque arm 74 is provided with a threaded aperture 84 adapted to carry a set screw 86. Setscrew 86 is adapted to seat into a locating recess 88 provided in and on the shaft 78.

Shaft 78 is made of stainless steel and has an elongated cylindrical portion 92, an enlarged shoulder portion 94, and an attachment portion 96. This attachment portion 96 is shown as being square, but other conventional drives systems may be used such as key and keyseat, flats splines and the like. The elongated cylindrical portion 92 is adapted to be journaled in each of the bearings 40.

USE AND OPERATION

Referring to FIG. 2, The piston assembly 52 closely fits into the precise bore of the hollow cylinder 12. Each end of the piston assembly 52 is precisely sized to provide a more or less bearing fit with the hollow cylinder 12. The piston 52 is preferably made of an acetal homopolymer which provides an excellent bearing material. This acetal homopolymer requires little or no lubrication. A machine screw 72 is threaded into aperture 68. The screw 72 engages the threaded aperture 68 with a more or less class 3 fit, which holds the screw 72 in its adjusted position. After the correct amount of angular rotation of the output shaft 78 is determined, screw 72 is threaded inwardly or outwardly as necessary. Only one screw has been shown in FIG. 2, but it is contemplated that two adjustment screws may be employed for finely tuning the angular rotation of the output shaft 78 at each extent.

Conventionally, each of the piston sealing means 56 stops the passage of the pressurized medium into the undercut portion 58 of the piston 52. This piston assembly 50 is carried to either end of the hollow cylinder 12 as a result of a differential in pressure between each end of the cylinder. If there is no differential in pressure the piston will not move.

The torque arm 74 is carried, at one end, by the elongated portion 92 of the output shaft 78. This torque arm 74 is positioned and retained on the shaft 78 by means of the setscrew 86 engaging the locating recess 88 in the shaft 78. This setscrew 86 may be tightened or loosened as needed for assembly or disassembly. An appropriate tool can be inserted into the setscrew 86 by aligning the setscrew 86 with the access aperture 44 of the housing portion 30. This alignment may be seen more clearly in FIG. 8. A cap screw 90 is provided to close the access hole 44 after the setscrew has been tightened. This cap screw 90 may have a suitable sealing means provided when and as needed.

The pair of shaped rollers 82, rotatably journaled on the axle end of the torque arm 74, ride in the closed end transverse groove 60. These rollers 82 are retained on the axle 80 by means of the closed ends 62 of the transverse groove 60. The pair of rollers 82 also maintain the alignment of the piston assembly 50 during its linear displacement from one end of the hollow cylinder 12 to the other end. It may be seen in FIG. 3, that the rollers 82 approach a more or less bottom-out condition in the transverse groove 60. The preferred clearance between the rollers 82 and the bottom 63 of the transverse groove 60 is in the range of 0.8 mm. to 1.6 mm.

Figure 7:
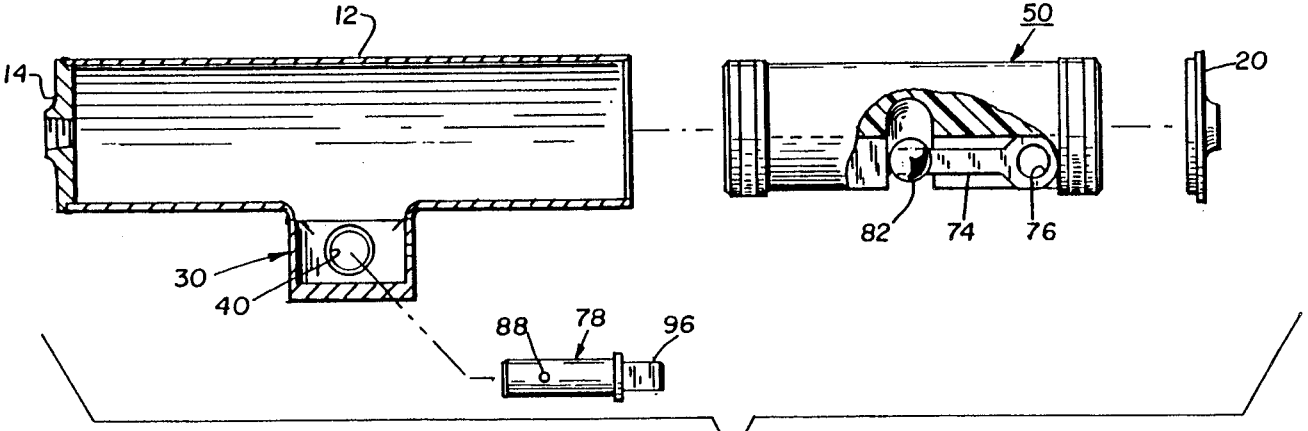
FIG. 7 represents an exploded view of the servo-actuator in a reduced scale, and showing the arrangement of parts just prior to final assembly.

The servo-actuator 10 is preferably assembled in the following manner. Referring to FIG. 7, a welded sub-assembly comprising a hollow cylinder 12, a housing portion 30 and a first closed end 14. The orientation and relationship of the housing 30 to the hollow cylinder 12 may be provided by a fixture prior to and during the welding operation. Each of these welds are produced to provide a more or less leak-proof joint.

A piston assembly 50 comprising a pair of piston sealing means 56 and one or two adjustment means such as screws 72 is aligned with the welded sub-assembly. A torque arm assembly including the torque arm 74, and a pair of shaped rollers 82 carried on the axle 80, is placed into the longitudinal groove 64 as shown in FIG. 7. This longitudinal groove 64 having a sufficient length to allow the torque arm assembly to completely seat within the piston assembly 50 more or less as shown. This piston assembly 50 along with the torque arm assembly is inserted into the open end of the hollow cylinder 12. The interior diameter of the hollow cylinder 12 is provided with a chamfered lead-in portion to allow the piston assembly 50 to be easily inserted into the hollow cylinder 12. As and when the piston 50 is moved toward and past the center of the cylinder 12, the torque arm 74 swings into the well portion 36 of the housing 30. Preferably, the bearings 40 have been previously assembled into the housing 30. The torque arm 74 is brought to a more or less forty-five degree angle, as may be seen in FIG. 8. The shaft 78 is positioned into the bored hole 76 of the torque arm and simultaneously into the bearings 40. The locating recess 88 is aligned with the setscrew 86. The setscrew 86 is then tightened, by using a proper and appropriate tool, to engage the shaft 78. The second closed end 20 is positioned into the open end of the cylinder 12 and then continuously welded in place Each of the welds may be ground when and as necessary to provide a smooth exterior surface. This grinding operation would only be necessary to eliminate any places where bacterior may grow.

In summary the piston 52 is aligned by the hollow cylinder 12. The torque arm 74 is located by the piston 50. The shaft 78 is retained and located by the torque arm 74.

The preferred embodiment of the present invention as shown and described provides a compact servo-actuator. This embodiment of the servo-actuator providing an adjustable angular rotation of the output shaft 78. The maximum adjustment allowing for angular displacements up to ninety degrees, which should be sufficient to fully open a disk or butterfly valve. The angular rotation of the output shaft may be adjusted by means of one or two internal adjusting means 69.

Referring to FIG. 2, the screw 72 preferably is a socket head type. An Allen wrench is inserted into the passageway 18 and finally engaging the drive portion of the screw 72. After the proper adjustment is made, a fitting is inserted into the passageway 18 to carry the pressurized medium interior of the cylinder. An alternate arrangement may be provided which would allow adjustment of the screw 78 after initial installation into the equipment. In this alternate arrangement a street-tee, not shown, would be connected to the passageway 18 or 24. A male threaded portion of the street-tee is threaded into the passageway 18 or 24. A second port of the tee which is in opposed alignment with the male threaded end would carry a removable pipe plug. A third port, at ninety degrees to the male threaded portion of the street tee is connected to a conduit carrying the pressurized medium. When and if an adjustment is necessary, a technician is required to remove the pipe plug from the second port. Adjustment would be made by inserting an appropriate elongated tool through the street-tee and into the screw 78. The pipe plug would again be used to close the second port for proper operation of the servo-actuator.

DESCRIPTION OF FIG. 8 AND FIG. 9

Figure 9:
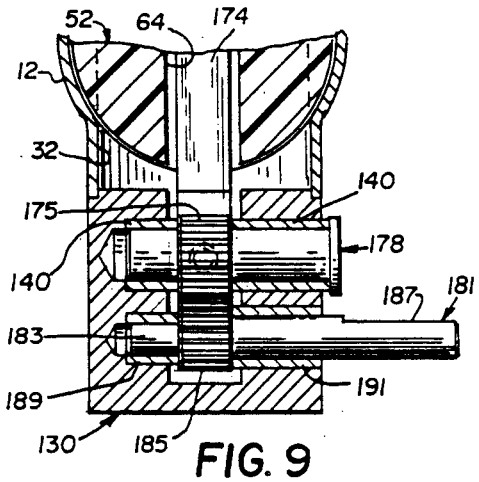
FIG. 9 represents a side elevation view of the alternate embodiment of a housing portion. This view taken along line 9—9 of FIG. 8.
Figure 8:
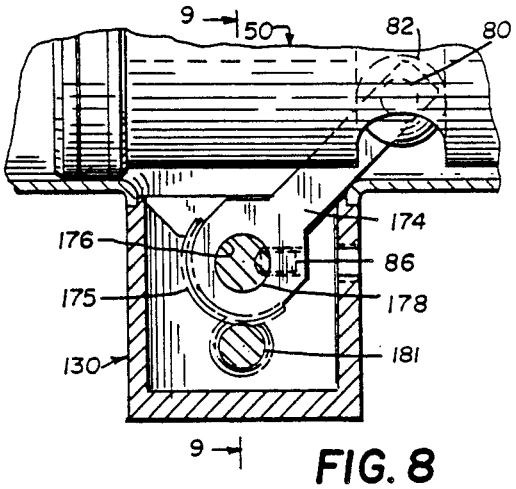
FIG. 8 represents a fragmentary side elevational view, in section, of an alternate embodiment of the servo-actuator, showing, in particular, a housing portion containing a geared arrangement.

Referring to FIG. 8 and FIG. 9, an alternate embodiment is shown. In this embodiment a servo-actuator is disclosed which provides an angular rotation of its output shaft 181 which is greater than ninety-degrees. A housing 130 carries an elongated torque arm 174. This torque arm 174 has a through aperture 176 adapted to fit onto and over idler shaft 178. The torque arm 174 is similar, in construction, to torque arm 74, which has been previously described, with the exception that a gear segment 175 is formed at and near the end attached to the shaft 178. The shaft is journaled in bearings 140 which are press-fit into the housing 130. An parallel elongated output shaft 181 has a first cylindrical portion 183, a gear portion 185 and an elongated drive portion 187. This output shaft 181 is rotatably journaled in a first bearing 189 and a second bearing 191. Each of these bearings 189 and 191 are press-fit into the housing 130.

In use and operation the embodiment shown utilizes 2:1 gear ratio. The output shaft 181 will rotate one hundred eighty degrees when the piston assembly 50 is displaced from one end of the hollow cylinder 12 to the other. The drive portion 187 of the shaft 181 is shown as having a flat portion. It is to be noted that other means may be provided to drive output devices. The housing 130 is welded in position to the hollow cylinder 12. Assembly of this alternate embodiment would be similar to servo-actuator 10. After the piston assembly 50 is in position and the torque arm 174 has dropped into the housing 130, idler shaft 178 is inserted into the housing 130. The setscrew 86 is correctly positioned into the idler shaft 178 and tightened in place. The output shaft 181 is inserted into the first bearing 189. This shaft 181 is arranged with its gear portion 185 meshing with gear segment 185. A second bearing 191 is then press-fit into position in the housing 130 to hold the shaft 181 in position.

The assembly of the servo-actuator is completed by inserting and welding the second closed end 20 into and to the open end of the hollow cylinder 12.

DESCRIPTION OF FIG. 10 AND FIG. 11

Figure 10:
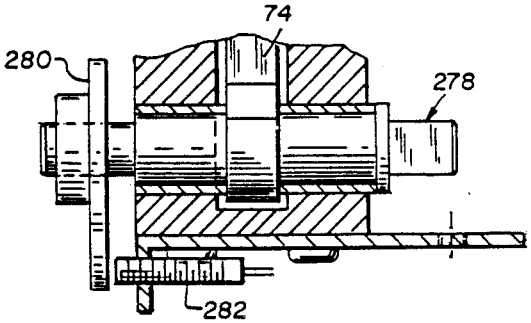
FIG. 10 represents an alternate embodiment of an adjusting means, this view is partly in section and partly diagrammatic.
Figure 11:
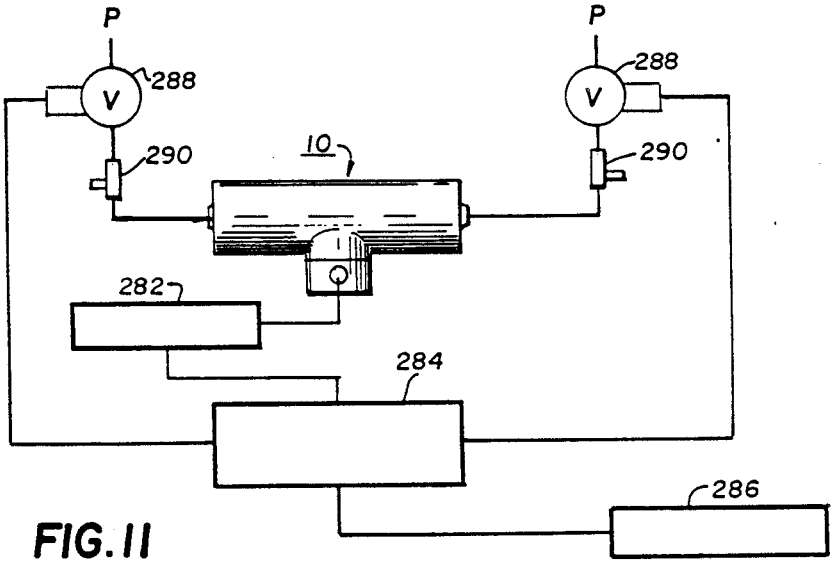
FIG. 11 represents a diagrammatic arrangement of one control system for an adjustable servo-actuator.

Referring in particular to FIG. 10 and FIG. 11, this servo-actuator may be automatically controlled. A double ended output shaft 278 would carry a flag member 280. A position sensing means 282, such as a proximity switch, air logic sensor, electric eye and the like may be used to sense the position of the flag member 280. Alternately an encoder means may be coupled to one side of the double ended shaft 278 to count the degrees of rotation. Information from the position sensing means 282 along with flow measuring means 286 from the product being dispensed, is sent to a control circuit or processor 284. This control circuit or processor 284 would stop the piston in a desired position by controlling either of valves 288. Each of these three-way valves 288 may be controlled by a low voltage electrical circuit or by a air logic pilot control circuit. The control circuit or processor 284 would allow instantaneous and automatic control of the flow of material through the disk or butterfly valve.

It is anticipated that the servo-actuator will be operated by a medium such as gas, air, or other fluids pressurized between 30 P.S.I.G. to 80 P.S.I.G.

It is further contemplated that an adjustable flow control valve 290 may be inserted in series between the pressurized medium source and the servo-actuator. This flow control valve 290 will control the velocity of the piston assembly 50, thereby controlling the angular velocity of the output shaft 78, 178, or 278 as desired.

As previously noted the piston material is preferably of an acetal homopolymer. The bearings are of an PTFE impregnated plastic material, therefore little or lubrication is required. All exterior metal components are of a non-corrosive material such as stainless steel, but is contemplated that other types of non-corrosive metals may be used.

The servo-actuator is completely enclosed to eliminate the possibility of leakage of contaminants into a product. The design of the servo-actuator eliminates metal to metal contact of parts eliminating any danger of generating sparks, metal shavings and the like.

In its construction and use, the servo-actuator assembly depicted and described above is believed to provide the basis for a method of construction and use. This method including the steps of:

providing a welded sub-assembly comprising a hollow cylinder, a first closed end with a passageway therethrough, and an enclosed housing having interior contoured surfaces;

providing a torque arm having a through aperture at a hub end and an elongated axle member at its distal end, said axle member having each of its ends extending from each side of the torque arm;

rotationally mounting a shaped roller on each extending end of the axle member;

providing a piston assembly, said piston assembly comprising a non-metallic piston, a sealing means at or near each end, said piston having a closed end transverse groove, and an elongated longitudinal groove;

positioning said torque arm with rollers mounted thereon into said longitudinal groove while simultaneously positioning said shaped rollers into said transverse groove;

inserting said piston assembly with said torque arm inserted therein into an open end of said welded sub-assembly to a selected position;

allowing said hub end of the torque arm to enter into an interior portion of said enclosed housing;

inserting an output shaft member into an aperture provided in said enclosed housing said shaft member having a drive portion extending exterior of said enclosed housing;

engaging said torque arm with said output shaft;

providing at least one adjustment means;

inserting a second end into said open end of the welded sub-assembly, said second end having a passageway therethrough; and welding said second end to the welded sub-assembly.

Terms such as "left", "right", "up", "down", "bottom", "top", "front", "back", "in", "out" and the like are applicable to the embodiments shown and described in conjunction with the drawings. These terms are merely for the purpose of description and do not necessarily apply to the position in which the servo-actuator of the present invention may be used or constructed.

While these particular embodiments of a servo-actuator has been shown or described, it is to be understood that the invention is not limited thereto and protection is sought to the broadest extent that the prior art allows.

What is claimed is:

1. An enclosed adjustable servo-actuator comprising:

(a) an elongated hollow cylinder having a first closed end and a second closed end;

(b) a first through passageway in said first closed end for introducing a pressurized medium interior of said first closed end;

(c) a second through passageway in said second closed end for introduction of said pressurized medium interior of the second closed end;

(d) an enclosed housing exterior of said hollow cylinder, said housing formed substantially at a longitudinal center of the hollow cylinder, said enclosed housing further adapted to communicate with the interior of said hollow cylinder;

(e) an elongated shaft journaled in said enclosed housing, an axis of said shaft arrayed in a transverse relationship with a longitudinal axis of said hollow cylinder, a drive portion of said shaft adapted to extend a selected distance exterior of said housing on at least one side;

(f) an elongated flat torque arm having a hub end and an axle end, said hub end adapted for engagement with said shaft, said torque arm adapted for mounting interior of said housing;

(g) an elongated axle fastened to the axle end of the torque are, said axle arrayed in parallel relationship with said elongated shaft, said axle having each of its end portions extending a selected distance from each side of said torque arm;

(h) a pair of shaped rollers, each of said shaped rollers rotatively carried on each end portion of said elongated axle;

(i) an elongated piston carried in sliding engagement interior of said hollow cylinder;

(j) an annular groove provided substantially at each end of said piston;

(k) a piston sealing means adapted to seat in said annular groove, said sealing means for stopping the passage of said pressurized medium into a center portion of the piston;

(l) a closed-end transverse groove formed substantially at the center of the piston, said transverse groove adapted for the entry of said shaped rollers carried on said axle of said torque arm;

(m) a closed-end longitudinal groove formed in said piston, said longitudinal groove adapted for the passage of the torque arm as and when needed; and (n) at least one adjustment means, each of said adjustment means carried on one end of said piston and interior of said hollow cylinder, said adjustment means arrayed for limiting a linear displacement of said piston, said linear displacement reactive to the selective alternate introduction of said pressurized medium into the first or second closed end, said adjustable linear displacement controlling the arcuate rotation of said shaft, said shaft rotation caused by the engagement of said rollers carried on said torque arm in the closed end transverse groove of the piston.

2. An enclosed adjustable servo-actuator as recited in claim 1 wherein all exterior components are of a non-corrosive material.

3. An enclosed adjustable servo-actuator as recited in claim 2 wherein said non-corrosive material includes stainless steel.

4. An enclosed adjustable servo-actuator as recited in claim 3 wherein said elongated piston is made of a rigid non-metallic material requiring little or no lubrication.

5. An enclosed adjustable servo-actuator as recited in claim wherein said rigid non-metallic material includes an acetal-homopolymer.

6. An enclosed adjustable servo-actuator as recited in claim 1 wherein said closed-end transverse groove provides a means for maintaining radial orientation of the piston.

7. An enclosed adjustable servo-actuator as recited in claim 6 wherein said closed-end transverse groove further includes radiused end portions and radiused bottom portions.

8. An enclosed adjustable servo-actuator as recited in claim 7 wherein each of said shaped rollers has a contoured radiused portion adapted to mate with the radiused end and bottom portions of said closed-end transverse groove.

9. An enclosed adjustable servo-actuator as recited in claim 1 wherein said adjustment means further comprises:

(a) a threaded aperture formed in at least one end of said piston, said threaded aperture located in substantial alignment with said first and second through passageway;

(b) a machine screw adapted to engage said threaded aperture, said machine screw having a suitable head portion and a drive means; (c) a seating means provided at the entry end of said threaded aperture, said seating means adapted for the flush seating of the machine screw as and when all screw threads are fully engaged; and (d) said threaded aperture adapted to retentively maintain an inward or outward adjustment of said machine screw, this inward or outward adjustment providing a means for limiting said linear displacement of said piston.

10. An enclosed adjustable servo-actuator as recited in claim 1 wherein said housing further includes a gear drive for providing a reciprocal angular displacement of said elongated shaft up to one-hundred-eighty degrees.

11. An enclosed adjustable servo-actuator as recited in claim 1 wherein said drive portion of said elongated shaft includes a square contour.

12. An enclosed adjustable servo-actuator comprising:

(a) an elongated hollow cylinder having a first closed end and a second closed end;

(b) a first through passageway in said first closed end for introducing a pressurized medium interior of said first closed end;

(c) a second through passageway in said second closed end for introduction of said pressurized medium interior of the second end;

(d) an enclosed housing exterior of said hollow cylinder, said housing formed substantially at a longitudinal center of the hollow cylinder, said enclosed housing further adapted to communicate with the interior of said hollow cylinder;

(e) an elongated shaft journaled in said enclosed housing, an axis of said shaft arrayed in a transverse relationship with a longitudinal axis of said hollow cylinder, a first end portion of said shaft adapted to extend a selected distance exterior from one side of said housing and a second end portion extending a selected distance from an opposing side of said housing;

(f) an elongated flat torque arm having a hub end and an axle end, said hub end adapted for engagement with said shaft, said torque arm adapted for mounting interior of said housing;

(g) an elongated axle fastened to the axle end of the torque arm, said axle arrayed in parallel relationship with said elongated shaft, said axle having each of its end portions extending a selected distance from each side of said torque arm, (h) a pair of shaped rollers, each of said shaped rollers rotatively carried on each end portion of said elongated axle;

(i) an elongated piston carried in sliding engagement interior of said hollow cylinder;

(j) an annular groove provided substantially at each end of said piston;

(k) a piston sealing means adapted to seat in said annular groove, said sealing means for stopping the passage of said pressurized medium into a center portion of the piston;

(l) a closed-end transverse groove formed substantially at the center of the piston, said transverse groove adapted for the entry of said shaped rollers carried on said axle of said torque arm;

(m) a closed-end longitudinal groove formed in said piston, said longitudinal groove adapted for the passage of the torque arm as and when needed; and (n) an adjustment means carried on either the first end portion or second end portion of said elongated shaft, and said adjustment means adapted for limiting a linear displacement of said piston, said linear displacement reactive to the selective alternate introduction of said pressurized medium into the first or second closed end, said adjustable linear displacement controlling the arcuate rotation of said shaft, said shaft rotation caused by the engagement of said rollers carried on said torque arm in the closed end transverse groove of the piston.

13. An enclosed adjustable servo-actuator as recited in in claim 12 wherein said adjusting means further includes:

a) a flag member retentively carried on one of the opposing ends of said elongated shaft;

(b) a sensing means for detecting the location of said flag, said sensing means adapted to provide a signal to a control circuit, said control circuit limiting said linear displacement.

14. An enclosed adjustable servo-actuator as recited in claim 12, wherein said adjustment means includes:

(a) an encoder coupled to said elongated shaft for determining the amount of arcuate rotation of said shaft;

(c) a control circuit for receiving said determination from said encoder, said control circuit adapted to provide selective automatic operation of said servo-actuator.

15. A method for making an enclosed adjustable servo-actuator which includes the steps of:

(a) providing a welded sub-assembly comprising:

(1) an elongated hollow cylinder;

(2) a first closed end of said hollow cylinder, said first closed end having a passageway therethrough; and (3) an enclosed housing exterior of said hollow cylinder, said enclosed housing substantially at the longitudinal center of said hollow cylinder, said enclosed housing further adapted to communicate with the interior of said hollow cylinder;

(b) providing a torque arm with a through aperture at a hub end, said torque arm having an elongated axle member at an end distal said hub end, said axle member having each of its end portions extending a selected distance from each side of the torque arm;

(c) rotationally mounting a shaped roller on each extending end portion of said axle member;

(d) providing a piston assembly, said piston assembly comprising a non-metallic piston and a sealing means substantially at each end of the piston, said piston having a closed-end transverse groove and an elongated longitudinal groove;

(e) positioning said torque arm with said shaped rollers mounted thereon into said longitudinal groove while simultaneously positioning said mounted shaped rollers into said closed-end transverse groove;

(f) inserting said piston assembly with said torque arm and rollers inserted therein into an open end of said welded sub-assembly to a selected position;

(g) manipulating said hub end of the torque arm to enter into an interior portion of said enclosed housing;

(h) inserting an elongated output shaft member into an aperture provided in and through said enclosed housing, said shaft member having a drive portion extending exterior of said enclosed housing;

(h) providing a drive means between said output shaft and said hub end of said torque arm;

(i) providing at least one adjustment means for limiting the linear displacement of the piston assembly in the hollow cylinder;

(j) inserting a second end into an open end of the welded sub-assembly, said second end having a passageway therethrough; and (k) welding said second end to the welded sub-assembly to provide an air-tight connection.

16. A method as recited in claim 15 including the further steps of forming said non-metallic piston of an acetal-homopolymer.

17. A method as recited in claim 15 including the further steps of engaging said hub end of the torque arm on the elongated shaft.

18. A method as recited in claim 15 wherein the step of providing a drive means between the torque arm and the elongated shaft includes mounting a pair of gears interior of said enclosed housing.

19. A method as recited in claim 15 which includes the further steps of:

(a) forming said elongated hollow cylinder, said first closed end, said second closed end, said housing, and said output shaft of a stainless steel; and (b) grinding all welded joints smooth.

20. A method as recited in claim 15 wherein the step of providing at least one adjustment menas includes the further step of providing said adjustment means interior of said hollow cylinder.

* * * * *